US011817940B2

(12) United States Patent
Winter

(10) Patent No.: US 11,817,940 B2
(45) Date of Patent: Nov. 14, 2023

(54) METHOD FOR OPERATING A MEDIA REPRODUCTION DEVICE, AND MEDIA REPRODUCTION DEVICE

(71) Applicant: AUDI AG, Ingolstadt (DE)

(72) Inventor: Christian Winter, Ingolstadt (DE)

(73) Assignee: AUDI AG, Ingolstadt (DE)

( * ) Notice: Subject to any disclaimer, the term of this patent is extended or adjusted under 35 U.S.C. 154(b) by 275 days.

(21) Appl. No.: 17/429,167

(22) PCT Filed: Jan. 22, 2020

(86) PCT No.: PCT/EP2020/051525
§ 371 (c)(1),
(2) Date: Aug. 6, 2021

(87) PCT Pub. No.: WO2020/160908
PCT Pub. Date: Aug. 13, 2020

(65) Prior Publication Data

US 2022/0416922 A1 Dec. 29, 2022

(30) Foreign Application Priority Data

Feb. 7, 2019 (DE) ..... 10 2019 201 605.7

(51) Int. Cl.
*H04H 20/26* (2008.01)
*H04H 20/24* (2008.01)
*H04H 60/51* (2008.01)

(52) U.S. Cl.
CPC ..... *H04H 20/24* (2013.01); *H04H 20/26* (2013.01); *H04H 60/51* (2013.01)

(58) Field of Classification Search
CPC ..... H04H 20/24; H04H 20/26; H04H 60/51
(Continued)

(56) References Cited

U.S. PATENT DOCUMENTS 5,946,606 A * 8/1999 Shimizu ..... H04B 17/19 455/67.11
8,620,248 B2 * 12/2013 Dehlink ..... G01S 13/931 375/322

(Continued)

FOREIGN PATENT DOCUMENTS

DE 102013015161 A1 3/2015
DE 102014114269 A1 4/2015

(Continued)

OTHER PUBLICATIONS

International Search Report and Written Opinion of the International Searching Authority directed to related International Patent Application No. PCT/EP2020/051525, dated Apr. 28, 2020, with attached English-language translation; 20 pages.

(Continued)

*Primary Examiner* — April G Gonzales
(74) *Attorney, Agent, or Firm* — Sterne, Kessler, Goldstein & Fox P.L.L.C.

(57) ABSTRACT

The present disclosure relates to a method for operating a media reproduction device for a motor vehicle. Media information is received in a first and a second reception mode and reproduced based on the strength of the first and second reception. A temporal transmission delay between the reception modes is detected and compensated for by an electronic computing device. The surroundings of the motor vehicle are divided into at least two reception tiles, and each reception tile is assigned a first and a second reception strength value. The electronic computing device decides which reception mode to use to receive the media information in each reception tile and when to compensate the temporal transmission delay if it has been determined that the media information is received in the first reception tile in (Continued)

the first reception mode and in the second reception tile in the second reception mode.

7 Claims, 1 Drawing Sheet

(58) Field of Classification Search
USPC ..... 455/3.01
See application file for complete search history.

(56) References Cited

U.S. PATENT DOCUMENTS

| | | | | |
|---|---|---|---|---|
| 9,705,616 | B2 * | 7/2017 | Oldewurtel | H04H 20/24 |
| 10,027,431 | B2 * | 7/2018 | Martinez Diez | H04H 60/41 |
| 2004/0233797 | A1 * | 11/2004 | Obata | G11B 23/0308 369/30.03 |
| 2006/0245605 | A1 * | 11/2006 | Matsunaga | H04H 60/43 381/123 |
| 2015/0079916 | A1 * | 3/2015 | Wolf | H04B 1/1027 455/135 |
| 2015/0098584 | A1 * | 4/2015 | Emani | H04R 3/00 381/81 |
| 2016/0119066 | A1 * | 4/2016 | Oldewurtel | H04H 20/26 367/197 |
| 2019/0215729 | A1 * | 7/2019 | Oyman | H04L 65/1016 |
| 2021/0006614 | A1 * | 1/2021 | Oyman | H04L 65/70 |
| 2023/0164383 | A1 * | 5/2023 | Candelore | H04N 21/41407 725/62 |

FOREIGN PATENT DOCUMENTS

| | | | |
|---|---|---|---|
| DE | 102013009670 | B4 | 1/2016 |
| DE | 102014226139 | A1 | 6/2016 |
| DE | 102016206527 | A1 | 10/2017 |
| EP | 3407512 | A1 | 11/2018 |
| WO | WO 2014/194970 | A1 | 12/2014 |
| WO | WO 2016/074693 | A1 | 5/2016 |
| WO | WO 2017/103538 | A1 | 12/2020 |

OTHER PUBLICATIONS

International Preliminary Report on Patentability directed to related International Patent Application No. PCT/EP2020/051525, completed Apr. 19, 2021, with attached English-language translation; 15 pages.

* cited by examiner

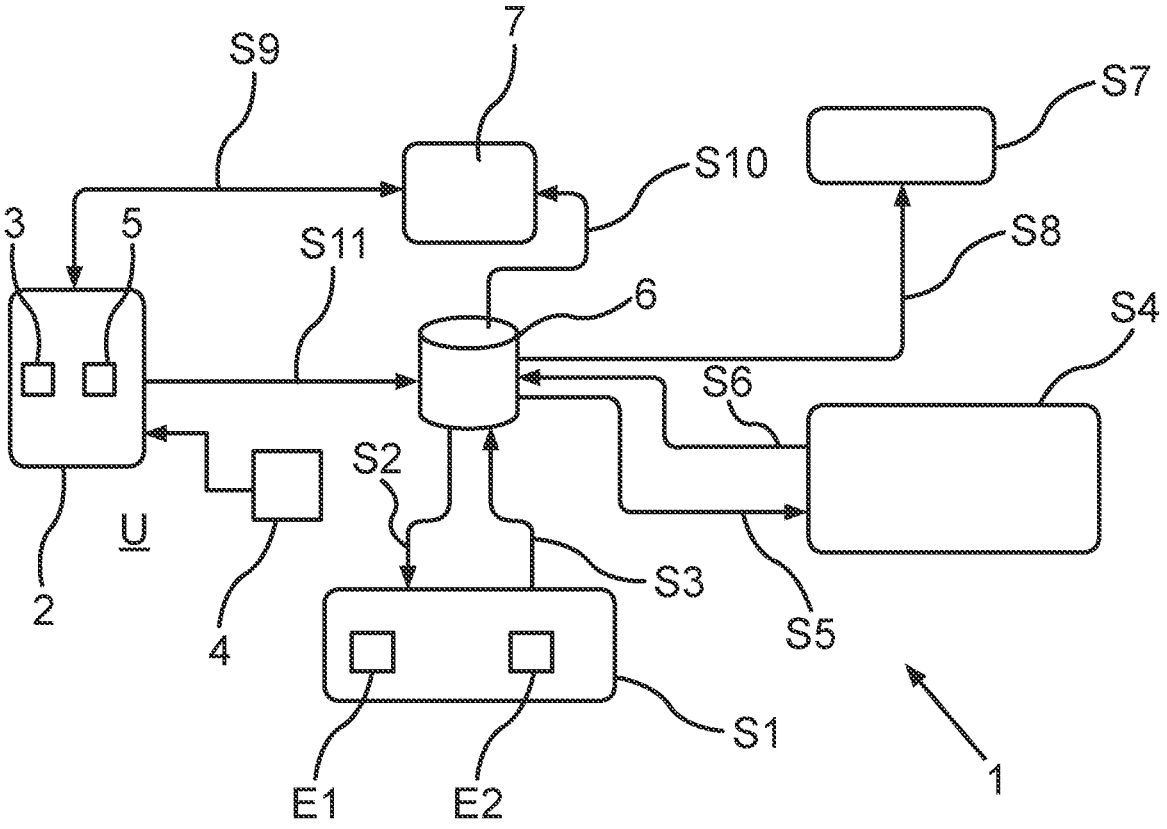
7
S9
S7
S10
3
5
S11
S8
6
S4
S6
S2
U
S3
2
4
S5
S1
1
E1
E2

METHOD FOR OPERATING A MEDIA REPRODUCTION DEVICE, AND MEDIA REPRODUCTION DEVICE

TECHNICAL FIELD

The present disclosure relates to a method for operating a media reproduction device for a motor vehicle, in which media information is received in a first reception mode and in which the media information is received in a second reception mode different from the first reception mode. Based on reception strength of the first reception mode and the second reception mode, the media information is reproduced by means of the media reproduction device using the first reception mode and the second reception mode, wherein a temporal transmission delay between the first reception mode and the second reception mode is detected when the media information is received by means of an electronic computing device and the temporal transmission delay is compensated for by means of the electronic computing device. The present disclosure also relates to a media reproduction device.

BACKGROUND

With today's hybrid radio functionality, the broadcast reception paths (FM, DAB, FM-HD radio) are connected to Internet radio in a motor vehicle. When there has been a loss of reception, it is possible to switch from broadcast to Internet stream and back again. The audio signals from the different reception paths or reception modes have different temporal transmission delays, so-called delays. This means that switching when reception is lost can result in the listener, in particular a user of the motor vehicle, skipping or hearing part of the radio program twice.

Time-scaling algorithms are used to recognize and compensate for this delay by comparing the two signals for their temporal difference and adjusting them.

For example, DE 10 2013 009 670 B4 discloses a method for acoustically emitting radio signals in a vehicle, in which radio signals can be transmitted into the vehicle and received there via a first and at least one second reception path. The first reception path is evaluated by at least one criterion parameter based on a received radio signal, and the second reception path is likewise evaluated by a criterion parameter based on the received radio signal. While the radio signal is being broadcast, a preparation phase for preparing a switch from the current reception path to the other reception path is started via one of the reception paths, depending on a comparison of the criterion parameter of the current reception path with a first threshold value, and a comparison of the criterion parameter of the current reception path is carried out with a second threshold value that is lower than the first threshold value, and if the value falls below the second threshold value, a check of the switchover to the other reception path is carried out.

Furthermore, DE 10 2016 206 527 A1 discloses a method for providing field strength information of a radio network for position-sensitive media reproduction devices in a vehicle, a method for media reproduction in a vehicle, and a vehicle. It is provided that a plurality of vehicles measures the local field strength of the radio network at a plurality of measurement positions and the plurality of vehicles provide the measured local field strengths and the associated measurement positions, a dynamic field strength profile of the radio network being generated and made available from the plurality of local field strengths and the associated measurement positions. It is thus possible to recognize local impairments of the field strength of a radio network, so that the acoustic reproduction of media content can take place with an improved quality.

According to DE 10 2013 015 161 A1, a mobile Internet radio receiver, in particular for use in vehicles, comprises a radio interface for Internet communication via a cellular mobile network, means for selecting an Internet audio signal source and for outputting a first audio signal emitted from the selected Internet audio signal source, at least one receiving part for receiving digital and/or analog radio signals, for deriving a second audio signal with the same content as the first audio signal from the radio signals, and outputting the second audio signal, means for assessing the reception quality of at least one of the audio signals, and an audio signal output, to which the first audio signal or the second audio signal can be applied depending on the assessed reception quality.

EP 3 407 512 A1 provides a radio receiving device and a seamless switching method which are able to set a point in time for the start of reception of IP radio transmissions in the case of a seamless switch of the output signal from radio transmission to IP radio transmission. A controller updates a counter value with an update step (increase step or decrease step) corresponding to a quality range representing a range of reception quality including a reception quality so as to come close to a range evaluation value that is registered in the quality range that is a range of reception quality including a reception quality at the time. In this case, the quality range is set to a smaller numerical value, since the quality range indicates a range with lower reception quality. The controller then controls the start of receiving the IP radio transmission when the counter value falls below a predefined threshold value.

BRIEF DESCRIPTION OF THE DRAWINGS/FIGURES

FIG. 1 shows a block diagram in accordance with one embodiment of the method.

DETAILED DESCRIPTION

The object of the present disclosure is to create a method and a media reproduction device to carry out an improved reproduction of media information.

This object is achieved by a method and by a media reproduction device according to the independent claims. Advantageous embodiments are specified in the dependent claims.

One aspect of the present disclosure relates to a method for operating a media reproduction device for a motor vehicle, in which media information is received in a first reception mode and in which the media information is received in a second reception mode different from the first reception mode. Based on a first reception strength of the first reception mode and a second reception strength of the second reception mode, the media information is reproduced by means of the media reproduction device using the first reception mode or the second reception mode. A temporal transmission delay between the first reception mode and the second reception mode is detected when the media information is received by means of an electronic computing device and the temporal transmission delay is compensated for by means of the electronic computing device.

It is provided that the surroundings of the motor vehicle are divided into at least two reception tiles. Each reception tile is assigned a first reception strength value for the first reception strength and a second reception strength value for the second reception strength. The electronic computing device uses each first reception strength value and each second reception strength value, in which reception mode the media information is received in each reception tile and when the temporal transmission delay is compensated for when the motor vehicle passes from the first reception tile to the second reception tile, as soon as it is determined by means of the electronic computing device that the media information is received in the first reception tile in the first reception mode and in the second reception tile in the second reception mode.

In particular, the two above mentioned decisions are made by means of the electronic computing device depending on whether the media information is received in the first reception tile in the first reception mode and in the second reception tile in the second reception mode. The recognition that different reception modes are used to receive in the reception tiles is therefore a requirement, in particular also a triggering criterion, that the above-mentioned decision is carried out subsequently.

This makes it possible for the first reception tile and the second reception tile to be evaluated on the basis of their reception strength values for the first reception mode and for the second reception mode. If it turns out that, for example, the first reception mode in the first reception tile is better, i.e. has a higher reception strength value than the second reception mode, the first reception tile is can be provided that it is received within the first reception tile in the first reception mode. Should it then be determined that the second reception tile in the second reception mode provides better reception of the media information, the electronic computing means can decide, for example, on the basis of the current position and a navigation route, when the temporal transmission delay can be compensated for between the first reception tile and the second reception tile. Thus, an improved operation of the media reproduction device and an improved reception of the media information are made possible.

In other words, it can be provided that the media information is stretched or compressed, for example to compensate for the temporal transmission delay. The compensation is therefore a temporal compensation. For example, when driving pauses imperceptible to the user of the motor vehicle can be inserted, when driving, so that the media information is compressed in such a way during the passage from the first reception tile to the second reception tile that the user does not perceive, or substantially perceive, the switch from the first reception mode to the second reception mode. When media information is compressed, pauses can be shortened accordingly, without the user perceiving that the first reception mode has changed to the second reception mode.

For example, the first reception mode may be broadcast reception, and the second reception mode may be Internet radio. The broadcast is, for example, FM, DAB, FM-HD radio options. In other words, the media information can be received in the first reception mode via appropriate frequencies. In the case of Internet radio, media information can be called up or received in each case, in particular on the basis of data reception, for example by means of a mobile data connection, such as UMTS or WLAN. In one embodiment, it is preferred to receive the media information in the first reception mode, i.e. broadcast, since this allows data volume to be saved by means of the Internet radio. The media information should only be received in the second reception mode if the reception is restricted by means of broadcast. Accordingly, the method of the present disclosure allows the two reception modes to switch and thus reduce the data reception with high media information quality.

A reception tile is in particular a surface zone and thus a partial area of the surroundings that is viewed as an area.

In some aspects, the assigned reception strength values of the first reception tile are different from the assigned reception strength values of the second reception tile. This also means that the assigned first reception strength value of the first reception tile is different from the assigned first and second reception strength value of the second reception tile. In some aspects, the assigned second reception strength value of the first reception tile is different from the assigned first and second reception strength value of the second reception tile.

In some aspects, the surroundings of the motor vehicle are divided into a plurality of reception tiles and each first reception strength value and each second reception strength value are assigned to each reception tile of the plurality of reception tiles. Then, each temporal transmission delay can be correspondingly compensated for during each passage from one of the reception tiles to another of the reception tiles.

In some aspects, the compensation of the temporal transmission delay can also be carried out based on a motor vehicle's speed. In particular, the passage from one of the reception tiles to another of the reception tiles can thus be reliably determined, to allow the reception mode to change during the passage and the temporal transmission delay can be reliably compensated.

Furthermore, the switching according to a reception tile may be skipped in a route which passes through a large number of reception tiles. For example, if it is determined that it is not possible to compensate for the temporal transmission delay for each of the reception tiles without loss of quality, switching may be skipped. In another example, the motor vehicle can drive through three reception tiles where the media information is received in the first reception tile in the first reception mode, in the second reception tile in the second reception mode, and in the third reception tile in the first reception mode. If, for example, the electronic computing device determines that a temporal transmission delay from the second reception tile to the third reception tile is 30 seconds, but the motor vehicle is in the second reception tile for less than 30 seconds due to the predefined navigation route, the switch can be skipped and the media information can be received in the first reception mode when passing through the three reception tiles.

In some aspects, the first reception strength value in the first reception tile is different than in the second reception tile. The second reception strength value may also be different than in the second reception tile.

According to an advantageous embodiment, the surroundings are divided into a plurality of reception tiles, wherein a reception tile is defined by a predefined area of the surroundings. For example, the area of the surroundings can be defined in predefined area sizes, for example in one kilometer by one kilometer, or one square kilometer. This allows the surroundings to be divided into small parts to then determine when the media information can reliably be received in the first reception mode or in the second reception mode. In particular, the predefined size area can also be dependent on the surroundings. For example, reception tiles that describe or contain a motorway can be drawn correspondingly long so that the switch time and the compensation of the temporal transmission delay can be reliably determined and compensated for at a high speed of the motor vehicle. Furthermore, the predefined area can also be described by geographical features of the surroundings, for example a hilltop, so that specific geographical features, which in particular influence the reception of the first reception mode or the second reception mode, can also be considered when generating the reception tiles. As a result, the reception of the media information can be improved reliably and precisely.

The generation of the reception tiles can in particular be carried out inside the vehicle by means of an electronic computing device and/or outside the vehicle by means of an electronic computing device, such as a backend server.

It is also advantageous if the reception tiles are generated as rectangular reception tiles, in particular as square reception tiles. When the reception tiles have a predefined geometric shape, the reception tiles can be used to reliably determine which reception mode the media information can be called up or received by means of the motor vehicle. As a result, a simple prediction of when compensation for the temporal delay is necessary can be made when the reception tiles are simple and geometric. Furthermore, the reception tiles can be generated and each reception strength value can be determined with little computational effort.

In particular, the reception tiles are thus geometrically delimited and form a partial area of the surroundings. Furthermore, the first reception tile in particular adjoins the second reception tile, in particular the two reception tiles directly adjoin one another.

In a further advantageous embodiment, the first reception strength and the second reception strength are compared with one another to determine which reception mode to receive the media information. In other words, the reception mode in which the media information is called up is selected on the basis of the reception strength. If, for example, the reception strength of the first reception mode is higher, in particular better, than in the second reception mode, it can be provided that the media information is called up in the first reception mode in this reception tile. In particular, the first reception mode thus has, for example, a higher reception strength value than the second reception strength, so that the media information is called up in the first reception mode within this reception tile. Therefore, both the first reception strength value and the second reception strength value are assigned to each reception tile, which is then used to decide whether the media information is received in the first reception mode or in the second reception mode. If it turns out, for example, that the first reception strength value is the same as the second reception strength value, it can be decided, for example, that the media information is received in the first reception mode or in the second reception mode. In the case of the same reception strength values, the media information is preferably received in the first reception mode due to the saving of data volume. In particular, this can also be made dependent on, for example, if the motor vehicle should move out of a reception tile which has a higher first reception strength value and has thus received the media information in the first reception mode and is now entering a further reception tile, the first reception strength value and the second reception strength value being the same in the further reception tile, whereby the media information can be called up using the first reception mode since no compensation can be made between the first reception mode and the second reception mode. This can be done through the use of navigation information. It is therefore possible to decide in a highly flexible manner which reception mode the media information can be called up based on each reception strength value. This results in an improved reproduction of the media information.

In a further advantageous embodiment, the media information is received in the first reception mode and the first reception strength is divided into at least five levels. Based on this division, it is decided whether the media information is reproduced in the second reception mode. In other words, the media information is preferably received in the first reception mode. In particular, the first reception mode is broadcast, in which the media information can be received on a frequency basis. The second reception mode is in particular Internet radio, which receives the media information on the basis of data. For example, level 5 can mean that the media information is received using the first reception mode. At level 4, it can be the case, for example, that the second reception mode should be switched back to the first reception mode if it is received in the second reception mode. At level 3, it can be provided that the second reception mode is to be pushed into the background. At level 2, it can be provided, for example, that the second reception mode should run in the background and that the temporal transmission delay should be compensated. At level 1, it can be provided that a change to the second reception mode is carried out. The electronic computing device is designed to call up the media information in the first reception mode or in the second reception mode based on each classification.

It has also proven to be advantageous that the electronic computing device is only used to switch from the first reception mode to the second reception mode when the temporal transmission delay has been compensated. In other words, the switch from the first reception mode to the second reception mode only takes place when the temporal transmission delay is compensated, in particular is completely compensated, so that a user can no longer perceive the switch from the first reception mode to the second reception mode or from the second reception mode to the first reception mode. In particular, this can be done by compressing or stretching the media information. As a result, an improved user experience and listening experience can be realized.

It has also proven to be advantageous if there is an automatic change back from the second reception mode to the first reception mode when the first reception strength value exceeds a predefined threshold value. In particular, this has the advantage that the media information can be received in an improved manner, in particular more cost-effectively, in the first reception mode. Should the first reception strength value exceed a predefined threshold value, in particular the threshold value describes a reception strength defined by the user, the second reception mode is automatically switched to the first reception mode. In particular, the threshold value can also be defined in such a way that a predefined reception quality of the media information is achieved. This allows for an improved operation of the media reproduction device.

It has also proven to be advantageous if the electronic computing device is a central electronic computing device external to the vehicle, such as a cloud server or as a backend server. For this purpose, for example, the electronic computing device external to the vehicle can have a database in which the corresponding reception strength values for each reception tile are stored. Corresponding information can be transmitted to the motor vehicle via the reception tiles, in order to decide, at an early stage, when the media information is to be received in the first reception mode and when the media information is to be received in the second reception mode. This allows for improved operation of the media reproduction device.

It is also advantageous if the motor vehicle is used to generate reception strength information based on the determined reception strengths which is then transmitted anonymously to the electronic computing device to generate the reception tiles. Therefore logs, which can also be referred to as reports, can be generated as reception strength information by means of the motor vehicle. A large number of reports can be created using a large number of motor vehicles. In particular, the previously determined temporal transmission delays can also be recorded. For example, these reports are collected anonymized, and forwarded to the electronic computing device external to the vehicle like a backend server. These reports can then be saved in a database. By aggregating the data from a large number of motor vehicles, the reception tiles for each station are determined on the basis of the reception strength information, i.e. as a function of the reports. For example, these can then be divided into five levels from not receivable to very well receivable. It can then be provided that the motor vehicle having hybrid radio functionality for the set station can call up the calculated reception tiles in the surroundings thereof from the backend server. This recommendation can be forwarded to a decision-making body, for example a linking engine, which decides when it is necessary to start the first reception mode or the second reception mode in order to compensate for the temporal transmission delay before the reception is interrupted.

Another aspect of the present disclosure relates to a media reproduction device for a motor vehicle having a first receiving device for receiving media information in a first reception mode and having a second receiving device different from the first receiving device for receiving the media information in a second reception mode different from the first reception mode, wherein the media reproduction device is designed to carry out the method according to the preceding aspect. In particular, the method is carried out by means of the media reproduction device.

The media reproduction device has a processor device which is configured to carry out the method according to the present disclosure. For this purpose, the processor device can comprise at least one microprocessor and/or at least one microcontroller. Furthermore, the processor device can include a program code which is configured to carry out the embodiment of the method according to the present disclosure when executed by the processor device. The program code can be stored in a data memory of the processor device.

A further aspect of the present disclosure relates to a motor vehicle having a media reproduction device. The motor vehicle is designed in particular as a passenger vehicle.

The present disclosure also encompasses further developments of the media reproduction device which include features as previously described in conjunction with the further developments. For this reason, the corresponding further developments of the media reproduction device according to the present disclosure are not described again here. For this purpose, the media reproduction device has objective features which allow the method or an advantageous embodiment thereof to be carried out.

The present disclosure also comprises the combinations of the features of the described embodiments.

In the following, an embodiment of the present disclosure is described by way of example. For this purpose, the single drawing shows a schematic view of an embodiment of the method.

The embodiments explained below are preferred embodiments of the present disclosure. In the embodiments, the described components of the embodiments each represent individual features which are to be considered independent of one another and can develop the invention independently of one another. Therefore, the disclosure shall also comprise other combinations of the features of the embodiments than the ones presented. Furthermore, the described embodiments may also be supplemented by further features of the present disclosure as already described.

In FIG. 1, elements that are identical or functionally identical are provided with the same reference signs.

FIG. 1 shows a schematic view of a block diagram in accordance with one embodiment of the method. The drawing shows the mode of operation of a media reproduction device 1. The media reproduction device 1 is designed for a motor vehicle 2. The motor vehicle 2 has a first receiving device 3 for receiving media information 4 in a first reception mode and a second receiving device 5, different from the first receiving device 3, for receiving the media information 4 in a second reception mode different from the first reception mode.

In the method for operating the media reproduction device 1 for the motor vehicle 2, the media information 4 is received in the first reception mode and the media information 4 is received in a second reception mode different from the first reception mode, wherein, on the basis of a first reception strength of the first reception mode and a second reception strength of the second reception mode, the media information 4 is reproduced by means of the media reproduction device 1 on the basis of the first reception mode or the second reception mode, and wherein a temporal transmission delay between the first reception mode and the second reception mode is detected when the media information 4 is received by means of an electronic computing device 6 and the temporal transmission delay is compensated for by means of the electronic computing device 6.

It is provided that the surroundings U of the motor vehicle 2 are divided into at least two reception tiles E1, E2, and each reception tile E1, E2 is assigned a first reception strength value for the first reception strength and a second reception strength value for the second reception strength, and wherein the electronic computing device 6 is used to decide on the basis of each first reception strength value and each second reception strength value, in which reception mode the media information 4 is received in each reception tile E1, E2 and when the temporal transmission delay is compensated for when the motor vehicle 2 passes from the first reception tile E1 to the second reception tile E2, as soon as it is determined by means of the electronic computing device 6 that the media information 4 is received in the first reception tile E1 with the first reception tile and in the second reception tile E2 in the second reception mode.

This makes it possible for the first reception tile E1 and the second reception tile E2 to be evaluated based on their reception strength values for the first reception mode and for the second reception mode. If it turns out that, for example, the first reception mode in the first reception tile E1 is better, i.e. has a higher reception strength value than the second reception mode, then the media information 4 is received within the first reception tile E1 in the first reception mode. Should it then be determined that better reception of the media information 4 can be carried out in the second reception tile E2 in the second reception mode, the electronic computing device 6 can decide, for example, on the basis of the current position of the motor vehicle 2 and a navigation route of the motor vehicle 2, when the temporal transmission delay can be compensated for between the first reception tile E1 and the second reception tile E2. This results in an improved operation of the media reproduction device 1 and an improved reception of the media information 4.

In other words, it can be provided that the media information 4 is stretched or compressed, for example to compensate for the temporal transmission delay. When stretching, for example, pauses imperceptible to the user of the motor vehicle 2 can be inserted, so that the media information 4 is compressed in such a way during the passage from the first reception tile E1 to the second reception tile E2 that the user does not or does not substantially perceive the switch from the first reception mode to the second reception mode. In the event of compression, pauses can be shortened accordingly, so that a user cannot perceive either that the first reception mode has been changed to the second reception mode.

The first reception mode is, in particular, broadcast reception, and the second reception mode is, in particular, Internet radio, for example. The broadcast is, for example, FM, DAB, FM-HD radio options. In other words, the media information 4 can be received in the first reception mode via appropriate electromagnetic frequencies. In the case of Internet radio, media information 4 can be called up or received in each case in particular on the basis of data reception, for example by means of a mobile data connection, for example UMTS or WLAN. It is preferably provided that the media information 4 is received in the first reception mode, i.e. broadcast, since this allows data volume to be saved by means of the Internet radio. The media information 4 should only be received in the second reception mode if the reception is restricted by means of broadcast. Thus, by means of the method according to the present disclosure, it is possible to switch between the two reception modes and reduce the data reception with high media information quality.

The surroundings U of the motor vehicle 2 are divided into a plurality of reception tiles E1, E2 and each first reception strength value and each second reception strength value are assigned to each reception tile E1, E2 of the plurality of reception tiles E1, E2. Then each temporal transmission delay can then be correspondingly compensated for during each passage from one of the reception tiles E1, E2 to another of the reception tiles E1, E2.

The compensation of the temporal transmission delay can also be carried out on the basis of a speed of the motor vehicle 2. In particular, the passage from one of the reception tiles E1, E2 to another of the reception tiles E1, E2 can thus be reliably determined, so that when the reception mode is changed during the passage, the temporal transmission delay can be reliably compensated for.

It is also provided that the surroundings U are divided into a plurality of reception tiles E1, E2, wherein a reception tile E1, E2 is defined by a predefined area of the surroundings U. For example, it can be provided that the reception tiles E1, E2 are generated as rectangular, or square, reception tiles E1, E2. In particular, the reception tiles E1, E2 can be generated in a first step S1. In a second step S2, the electronic computing device 6 can read out the corresponding received values and tables for the defined reception tiles E1, E2. In a third step S3, the corresponding table or the reception tiles E1, E2 for the electronic computing device 6 are generated. In a fourth step S4, the regions, which can be embodied as polygons, for example, in other words the reception tiles E1, E2, can be assessed with regard to their quality. In a fifth step S5, the electronic computing device reads the quality of the regions and generates the regions or the reception tiles E1, E2 in a sixth step S6.

Furthermore, it can be provided in particular that, depending on a navigation device, for example the motor vehicle 2, the corresponding reception tiles E1, E2 can be transmitted to a seventh step S7, it being possible to carry out corresponding data visualization on the basis of corresponding navigation information. In particular, in an eighth step S8, corresponding views, indices, or layers can thereby be generated. A corresponding retrieval of the reception strength values of the reception tiles E1, E2 can for example be carried out in a ninth step S9 by the motor vehicle 2, then it also being possible to transmit the reception strength values to the motor vehicle 2 in the ninth step S9. In a tenth step S10, the electronic computing device 6 can transmit the regions or polygons, in particular the reception tiles E1, E2, for the requested position of the motor vehicle 2 to a mobile network 7, for example.

In an eleventh step S11, corresponding received values of the motor vehicle 2 can be transmitted to the electronic computing device 6, in particular via so-called reports. These reports can also be referred to as reception strength information.

In particular, it can also be provided that the media information 4 is received in the first reception mode and the first reception strength is divided into at least five levels and, on the basis of this division, it is decided whether the media information 4 is reproduced in the second reception mode.

In particular, it can also be provided that the electronic computing device 6 is only used to switch from the first reception mode to the second reception mode when the temporal transmission delay has been compensated. In particular, for this purpose, for example, a compression or a stretching can be carried out to compensate for the temporal transmission delay.

Furthermore, it can be provided that the second reception mode is switched back to the first reception mode if the first reception strength value exceeds a predefined threshold value. In particular, this has the advantage that the media information 4 can be received in an improved manner, in particular more cost-effectively, in the first reception mode. Should the first reception strength value exceed a predefined threshold value, in particular the threshold value describes a reception strength defined by the user, the second reception mode is automatically switched to the first reception mode. In particular, the threshold value can also be defined in such a way that a predefined reception quality of the media information 4 is achieved. This allows for an improved operation of the media reproduction device 1.

Furthermore, it can be provided that the electronic computing device 6 is provided as a central electronic computing device 6 external to the vehicle. For example, the electronic computing device 6 can be provided as a backend server or as a cloud server.

Furthermore, in the eleventh step S11, it can be provided that the motor vehicle 2 is used to generate reception strength information on the basis of the determined reception strengths, and the reception strength information for generating the reception tiles E1, E2 is transmitted, in particular anonymously, to the electronic computing device 6.

Furthermore, it can be provided that the information on the previous determination of the temporal transmission delay is used to start the temporal compensation algorithm between receiving the media information 4 using the first reception mode and the second reception mode before the second reception mode is reproduced. Only when the compensation, at least substantially, of the temporal transmission delay is reached, the second reception mode is started and the exact compensation is carried out. This has the consequence that less is streamed in the background, in particular whereby the data volume consumption can be reduced, thereby resulting, in particular, in cost saving.

The invention claimed is:

1. A method for operating a media reproduction device for a motor vehicle, the method comprising of:

dividing surroundings of the motor vehicle into at least a first reception tile and a second reception tile;

assigning a first reception strength value for a first reception strength and a second reception strength value for a second reception strength;

determining, by an electronic computing device, which of a first reception mode or a second reception mode is used to receive media information based on the first reception strength value and the second reception strength value in each reception tile;

receiving media information, based on the determining, in the first reception mode or the second reception mode, wherein the second reception mode is different from the first reception mode;

reproducing, by the media production device, the media information based on the first reception strength of the first reception mode and the second reception strength of the second reception mode;

detecting a temporal transmission delay between the first reception mode and the second reception mode when the media information is received;

compensating, by the electronic computing device, the temporal transmission delay when the motor vehicle passes from the first reception tile to the second reception tile;

switching, by the electronic computing device, from the first reception mode to the second reception mode when the temporal transmission delay has been compensated; and automatically switching back to the first reception mode if the first reception strength value exceeds a predefined threshold value, wherein the first reception tile in the first reception mode corresponds to broadcast reception and the second reception tile in the second reception mode corresponds to Internet radio, and wherein the media information reproduced is based on dividing the first reception strength into at least five levels and determining whether to reproduce the media information in the second reception mode is based on the divided first reception strength.

2. The method of claim 1, wherein the surroundings are divided into a plurality of reception tiles such that each reception tile is defined by a predefined area of the surroundings.

3. The method of claim 1, wherein the first reception tile and the second reception tile are generated as rectangular tiles or square tiles.

4. The method of claim 1, further comprising:

comparing the first reception strength with the second reception strength; and determining, based on the comparing, the reception mode to receive the media information.

5. The method of claim 1, wherein the electronic computing device is external to the motor vehicle.

6. The method of claim 1, wherein the motor vehicle is used to generate reception strength information based on the determined first reception strength value and the second reception strength value, and the reception strength information for generating the reception tiles is transmitted anonymously to the electronic computing device.

7. A media reproduction device for a motor vehicle, the media reproduction device comprising:

a first receiving device for receiving media information in a first reception mode; and a second receiving device, different from the first receiving device, for receiving the media information in a second reception mode different from the first reception mode, wherein the media reproduction device is configured to:

divide surroundings of the motor vehicle into at least a first reception tile and a second reception tile;

assign a first reception strength value for a first reception strength and a second reception strength value for a second reception strength;

determine, by an electronic computing device, which of a first reception mode or a second reception mode is used to receive media information based on the first reception strength value and the second reception strength value in each reception tile;

receive media information, based on the determining, in the first reception mode or the second reception mode, wherein the second reception mode is different from the first reception mode;

reproduce, by the media production device, the media information based on the first reception strength of the first reception mode and the second reception strength of the second reception mode;

detect a temporal transmission delay between the first reception mode and the second reception mode when the media information is received;

compensate, by the electronic computing device, the temporal transmission delay when the motor vehicle passes from the first reception tile to the second reception tile;

switch, by the electronic computing device, from the first reception mode to the second reception mode when the temporal transmission delay has been compensated; and automatically switch back to the first reception mode if the first reception strength value exceeds a predefined threshold value.

* * * * *